US010672336B2

(12) United States Patent
Lee et al.

(10) Patent No.: US 10,672,336 B2
(45) Date of Patent: Jun. 2, 2020

(54) ORGANIC LIGHT EMITTING DISPLAY AND METHOD FOR DRIVING THE SAME

(71) Applicant: LG DISPLAY CO., LTD., Seoul (KR)

(72) Inventors: Hyunjae Lee, Goyang-si (KR); Taeyoung Park, Anyang-si (KR); Dongjun Choi, Paju-si (KR); Dongsup Shim, Paju-si (KR); Ohgun Kwon, Yeoncheon-gun (KR)

(73) Assignee: LG DISPLAY CO., LTD., Seoul (KR)

( * ) Notice: Subject to any disclaimer, the term of this patent is extended or adjusted under 35 U.S.C. 154(b) by 362 days.

(21) Appl. No.: 14/964,093

(22) Filed: Dec. 9, 2015

(65) Prior Publication Data

US 2016/0171929 A1 Jun. 16, 2016

(30) Foreign Application Priority Data

Dec. 11, 2014 (KR) ..... 10-2014-0178791

(51) Int. Cl.
*G09G 3/3233* (2016.01)

(52) U.S. Cl.
CPC ..... *G09G 3/3233* (2013.01); *G09G 2320/048* (2013.01); *G09G 2320/0693* (2013.01); *G09G 2330/021* (2013.01); *G09G 2360/141* (2013.01); *G09G 2360/145* (2013.01)

(58) Field of Classification Search
CPC ..... G09G 2330/021; G09G 2320/048; G09G 2320/0693; G09G 3/30–3291; G09G 2320/043–045; G09G 2360/14–148
See application file for complete search history.

(56) References Cited

U.S. PATENT DOCUMENTS

2007/0091050 A1* 4/2007 Katayama ..... G09G 3/3688 345/98
2008/0246749 A1* 10/2008 Lee ..... G09G 3/3233 345/207
2009/0140657 A1* 6/2009 Hayashi ..... G09G 3/3426 315/152

(Continued)

OTHER PUBLICATIONS

Dictionary.com, "adjacent," in Dictionary.com Unabridged. Source location: Random House, Inc. http://dictionary.reference.com/browse/adjacent, Nov. 18, 2011, p. 1.*

*Primary Examiner* — Patrick F Marinelli
(74) *Attorney, Agent, or Firm* — Birch, Stewart, Kolasch & Birch, LLP.

(57) ABSTRACT

A method for driving an organic light emitting display according to an embodiment includes applying an initial value of a high potential driving power and a test pattern to a display panel and sensing changes in driving characteristics of the display panel while varying a voltage level of the high potential driving power from the initial value, deciding whether or not a sensed driving characteristic value of the display panel satisfies a predetermined condition, setting a voltage level of the high potential driving power obtained when the sensed driving characteristic value satisfies the predetermined condition, as a reference value of the high potential driving power, and adding a voltage margin to the reference value of the high potential driving power to determine a final value of the high potential driving power, and driving the display panel using the final value of the high potential driving power.

15 Claims, 15 Drawing Sheets

(56) References Cited

U.S. PATENT DOCUMENTS

| | | | | |
|---|---|---|---|---|
| 2009/0174731 | A1* | 7/2009 | Kim | G09G 3/20 345/690 |
| 2009/0201281 | A1* | 8/2009 | Routley | G09G 3/3233 345/212 |
| 2011/0050669 | A1* | 3/2011 | Ahn | G09G 3/3258 345/211 |
| 2011/0221784 | A1* | 9/2011 | Lee | G09G 3/3233 345/690 |
| 2013/0135272 | A1* | 5/2013 | Park | G09G 3/3233 345/211 |

* cited by examiner

ORGANIC LIGHT EMITTING DISPLAY AND METHOD FOR DRIVING THE SAME

This application claims the priority benefit of the Korean Patent Application No. 10-2014-0178791 filed on Dec. 11, 2014, which is incorporated herein by reference for all purposes as if fully set forth herein.

BACKGROUND OF THE INVENTION

Field of the Invention

Embodiments of the invention relate to an organic light emitting display and a method for driving the same.

Discussion of the Related Art

An active matrix organic light emitting display includes organic light emitting diodes (OLEDs) capable of emitting light by itself and has advantages of a fast response time, a high light emitting efficiency, a high luminance, a wide viewing angle, and the like.

The OLED serving as a self-emitting element includes an anode electrode, a cathode electrode, and an organic compound layer formed between the anode electrode and the cathode electrode. The organic compound layer includes a hole injection layer HIL, a hole transport layer HTL, an emission layer EML, an electron transport layer ETL, and an electron injection layer EIL. When a driving voltage is applied to the anode electrode and the cathode electrode, holes passing through the hole transport layer HTL and electrons passing through the electron transport layer ETL move to the emission layer EML and form excitons. As a result, the emission layer EML generates visible light.

The organic light emitting display has an array of pixels, each including the OLED, and a luminance of the pixels can be adjusted depending on the grayscale of video data. As shown in FIG. 1, each pixel according to the related art may include a driving thin film transistor (TFT) DT controlling a driving current applied to the OLED and a switching unit SC programming a gate-source voltage (hereinafter, referred to as "Vgs") of the driving TFT DT. The driving TFT DT generates a drain-source current (hereinafter, referred to as "Ids") based on the programmed Vgs and supplies the Ids to the OLED as the driving current. An amount of light emitted by the OLED is determined depending on the driving current.

A high potential driving power (hereinafter, referred to as "VDDEL") is applied to one electrode (for example, a drain electrode) of the driving TFT DT, and a low potential driving power (hereinafter, referred to as "VSSEL") is applied to the cathode electrode of the OLED, so that the driving current can flow in each pixel.

The VDDEL according to the related art exists in a saturation region RG2 on the Vds-Ids plane of the driving TFT DT as shown in FIG. 2, so that the stability of an operation of the driving TFT DT is secured. The saturation region RG2 indicates a voltage region in which the Ids does not substantially change in spite of changes in the Vds. The saturation region RG2 may be located on the right side of a boundary point BP on the Vds-Ids plane. An active region RG1 is differentiated from the saturation region RG2 by the boundary point BP and indicates a voltage region in which the Ids changes depending on changes in the Vds. The active region RG1 may be located on the left side of the boundary point BP on the Vds-Ids plane.

The VDDEL is uniformly determined with respect to all display panels of the same model in consideration of the electrical characteristics of a display panel including a drain-source voltage (hereinafter, referred to as "Vds") depending on the Vgs of the driving TFT DT, a line resistance of a power line, changes in an operating voltage Voled of the OLED, etc. As shown in FIG. 2, the VDDEL is determined to have a sufficient voltage margin Vmg from the boundary point BP in consideration of a process (or manufacturing) deviation of all the display panels, so that the driving TFT DT can always operate in the saturation region RG2. The boundary point BP may have a different value in each display panel due to minor deviations of the electrical characteristics. A voltage of the boundary point BP has a maximum value in the worst-performing display panel having a large characteristic deviation among the display panels of the same model and has a minimum value in the best-performing display panel not having any characteristic deviation among the display panels of the same model. The boundary point BP is characterized in that it may be shifted to the right due to the degradation of the driving TFT DT and the OLED over time.

As shown in FIG. 3, the related art determines the voltage (8V) of the boundary point BP of the worst-performing display panel (A) among the display panels of the same model as a reference voltage and adds a voltage margin Vmg1 (0.5V) to the reference voltage in consideration of changes over time, thereby determining a final VDDEL (8.5V). Then, the final VDDEL (8.5V) is applied to the best-performing display panel (B) as well as the worst-performing display panel (A). As described above, in the related art, because the VDDEL applied to the display panels of the same model is determined based on the worst-performing display panel, the voltage margin from the boundary point BP has a different value in each display panel. Namely, the voltage margin Vmg1 may be 0.5V in the worst-performing display panel (A), but the voltage margin Vmg2 may be 1.5V in the best-performing display panel (B). According to the related art, display panels having the electrical characteristics similar to the best-performing display panel have unnecessarily large voltage margins.

Such unnecessarily large voltage margin leads to an unnecessary increase in power consumption. The problem is accentuated in mobile devices and smart devices implementing the organic light emitting display. In wearable smart devices having small-capacity battery power, low power consumption is of paramount importance. Therefore, the related art method of uniformly determining the VDDEL in a non-optimal manner is not suitable to be applied to certain OLED devices such as wearable smart devices.

SUMMARY OF EMBODIMENTS OF THE INVENTION

Accordingly, embodiments of the invention provide an organic light emitting display and a method for driving the same capable of preventing or minimizing an excessive voltage margin from being added to a high potential driving power and reducing power consumption by optimizing the high potential driving power based on each display panel.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

Figure 1:
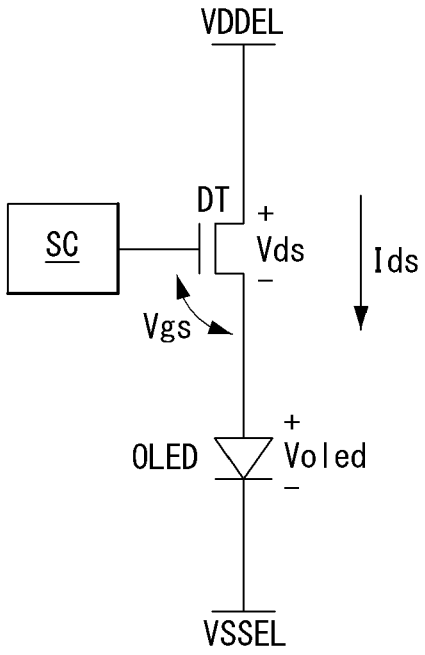
FIG. 1 (RELATED ART)
FIG. 1 schematically shows a connection configuration of a pixel including an organic light emitting diode (OLED)
Figure 2:
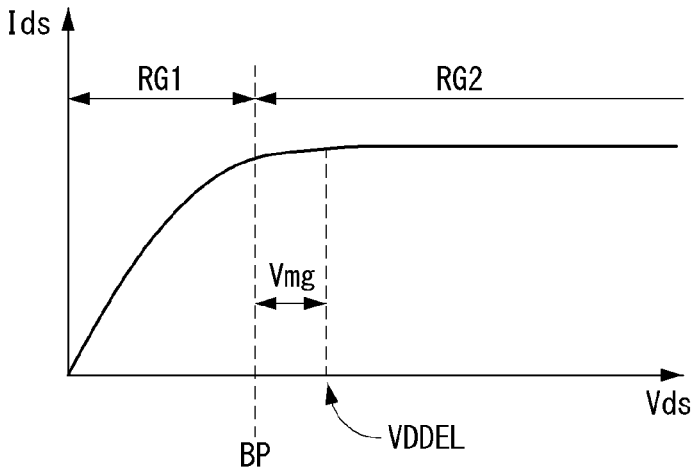
FIG. 2 (RELATED ART)
Figure 3:
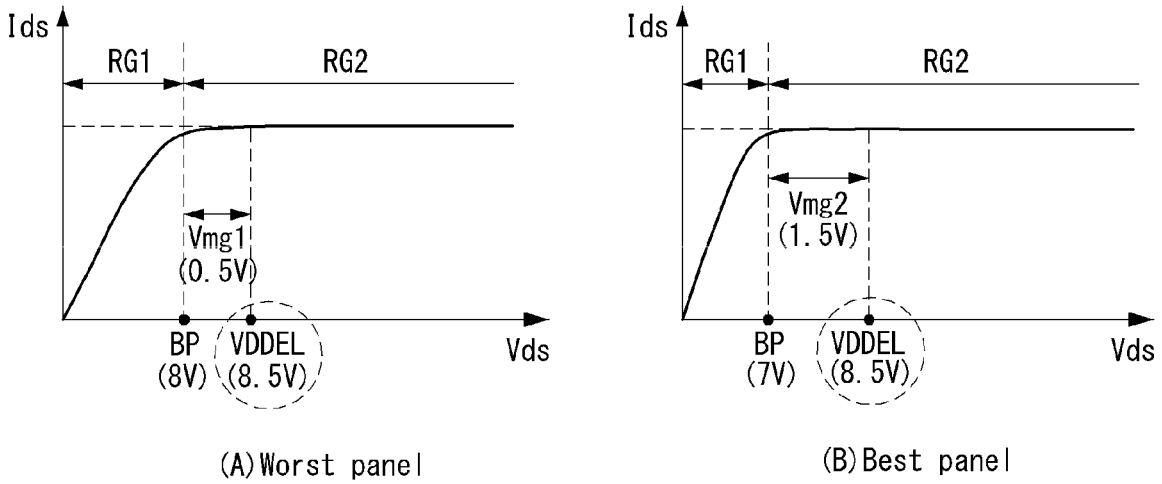
FIG. 3 (RELATED ART)
Figure 4:
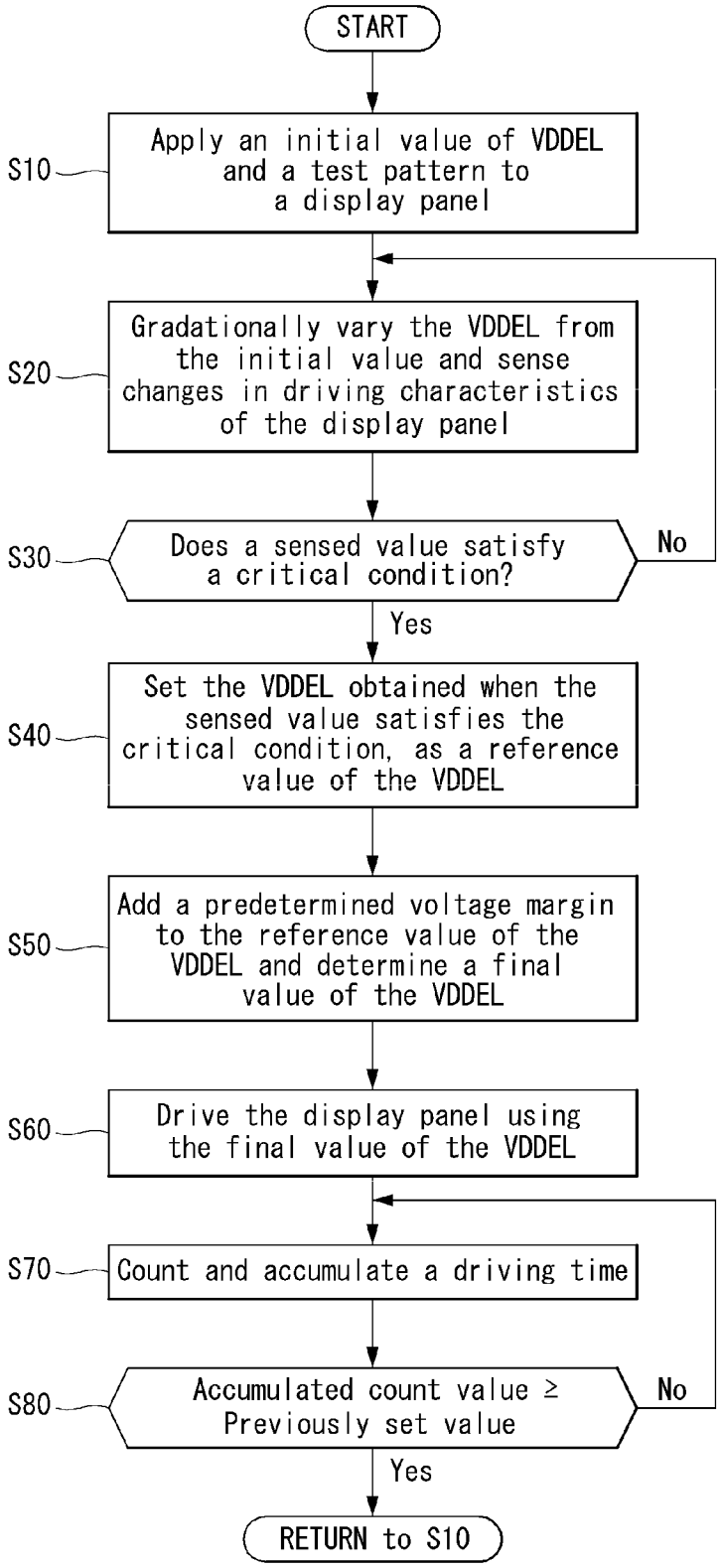
Figure 5:
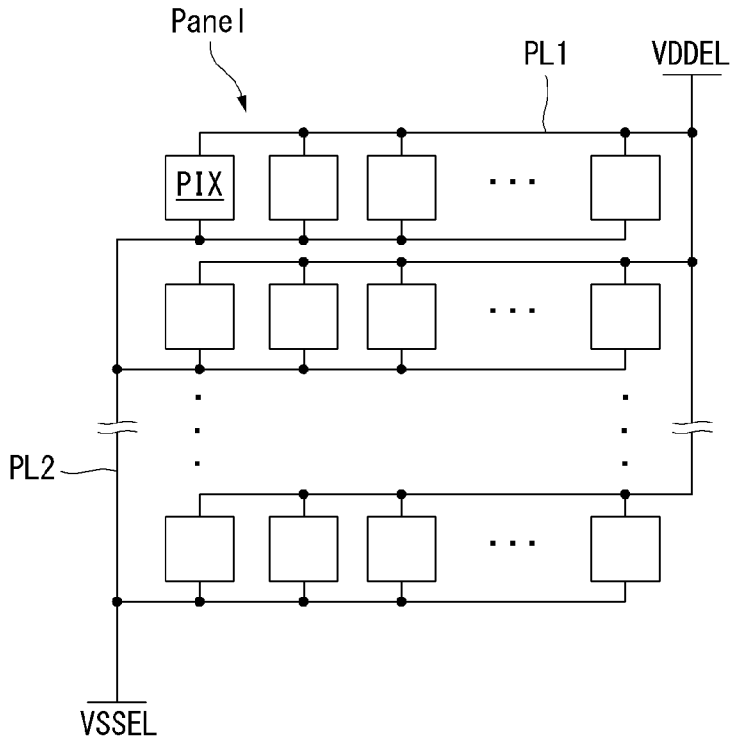
Figure 6:
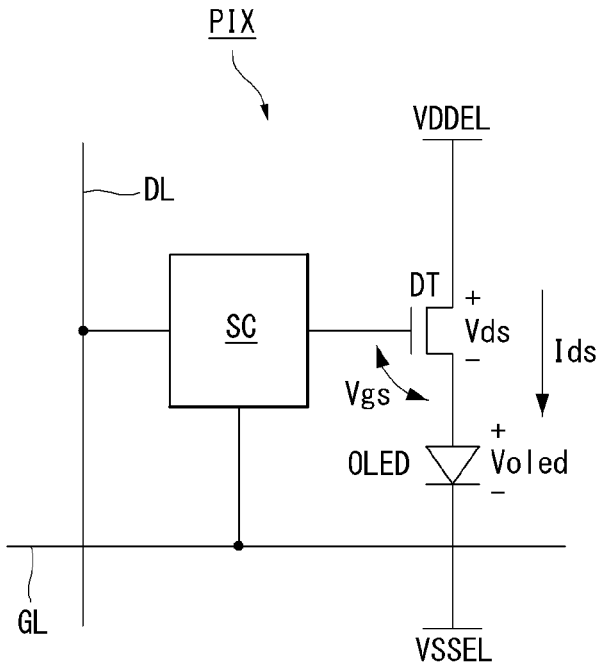
Figure 7:
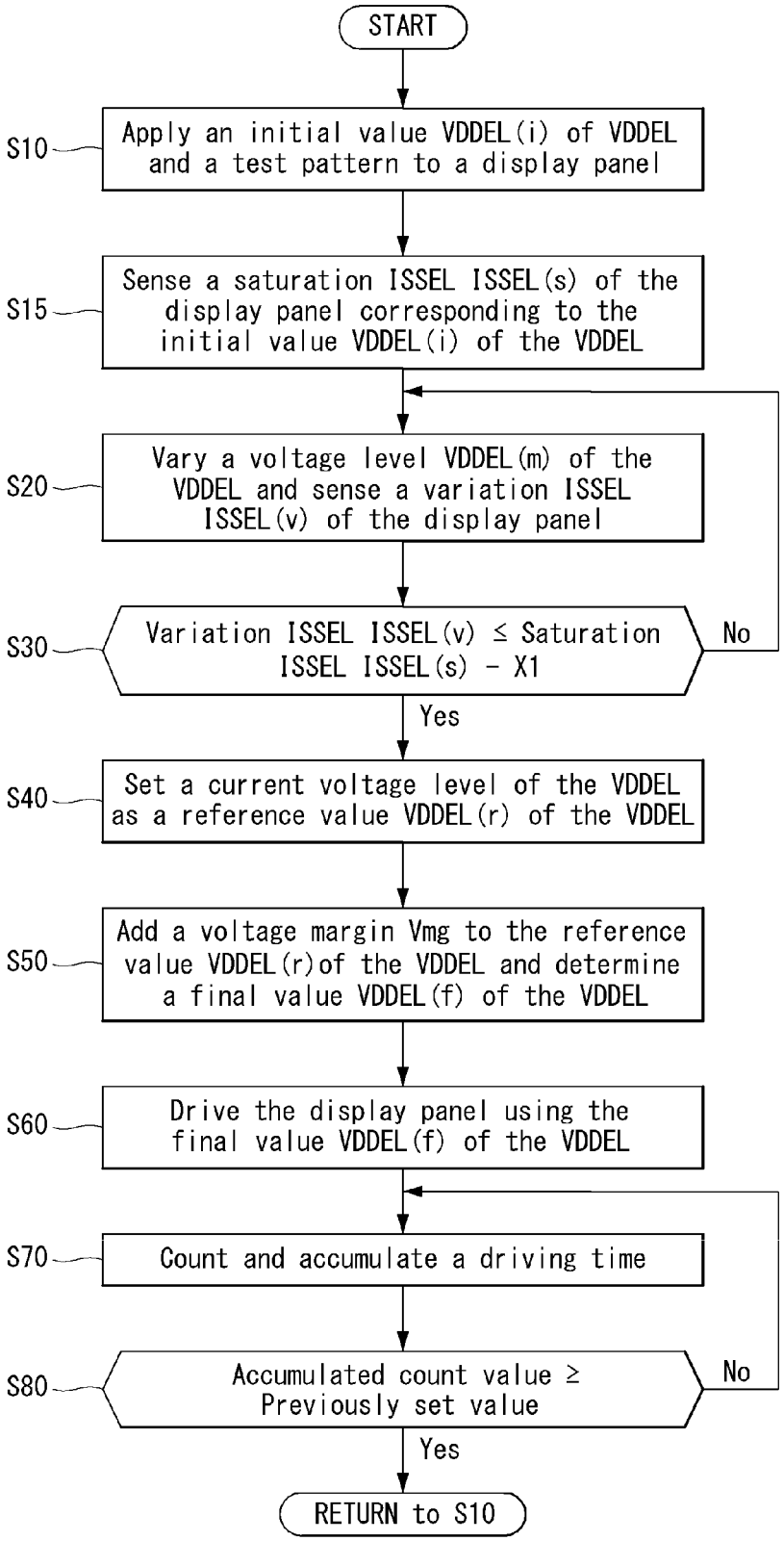
Figure 8:
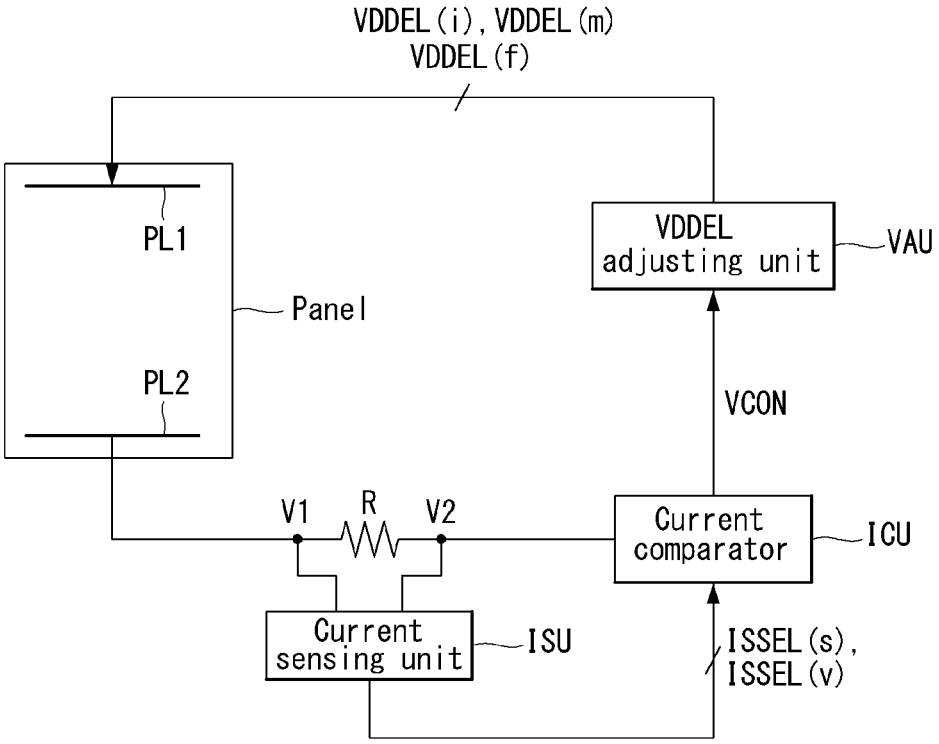
Figure 9:
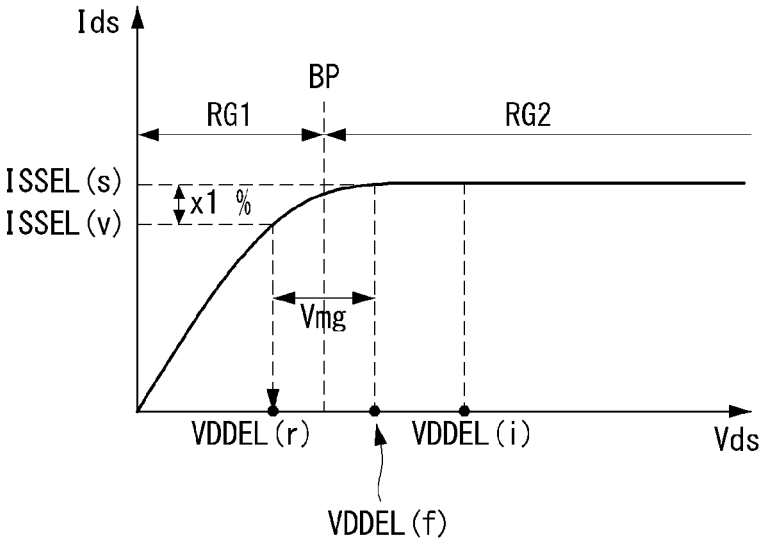
Figure 10:
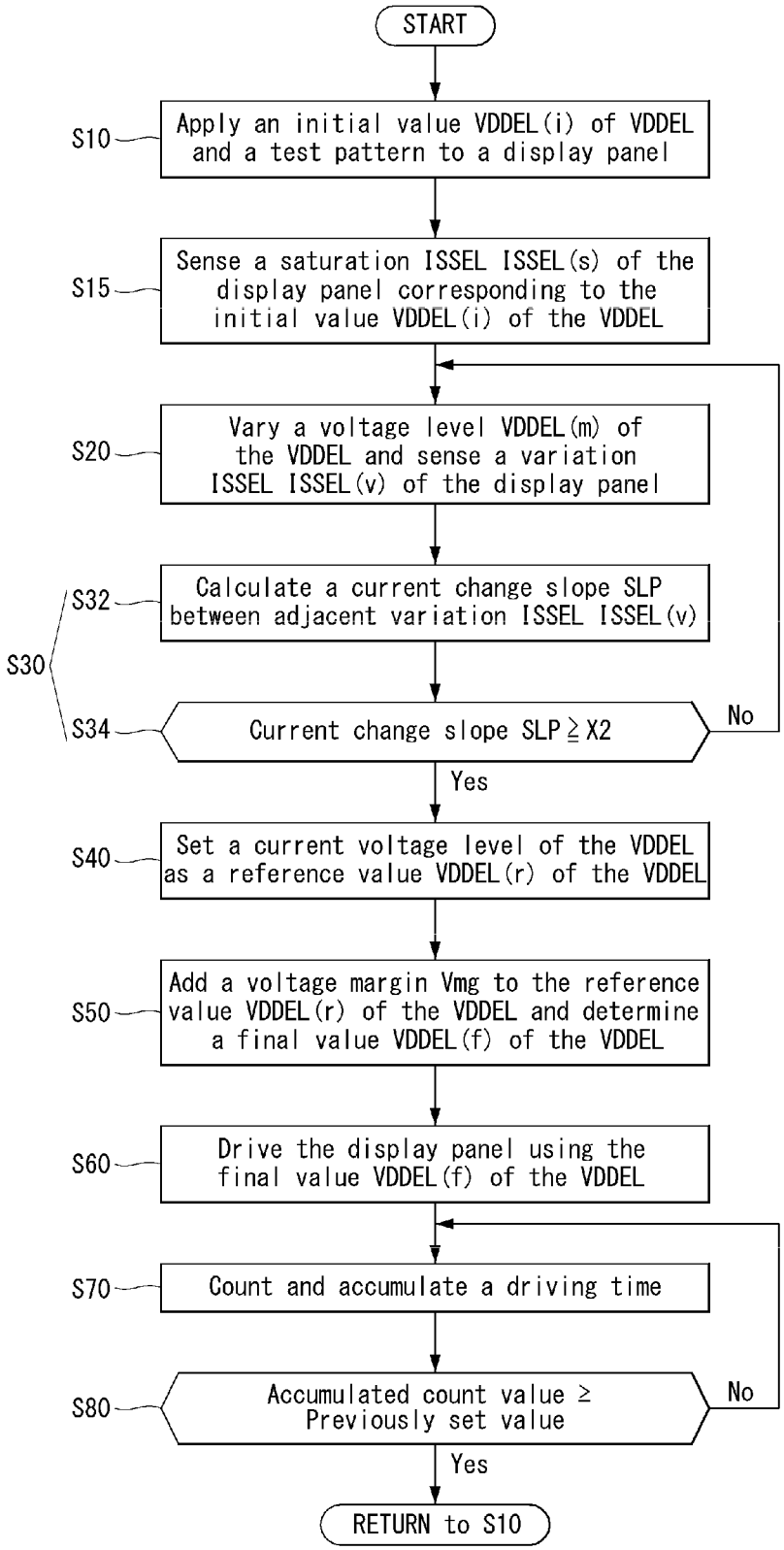
Figure 11:
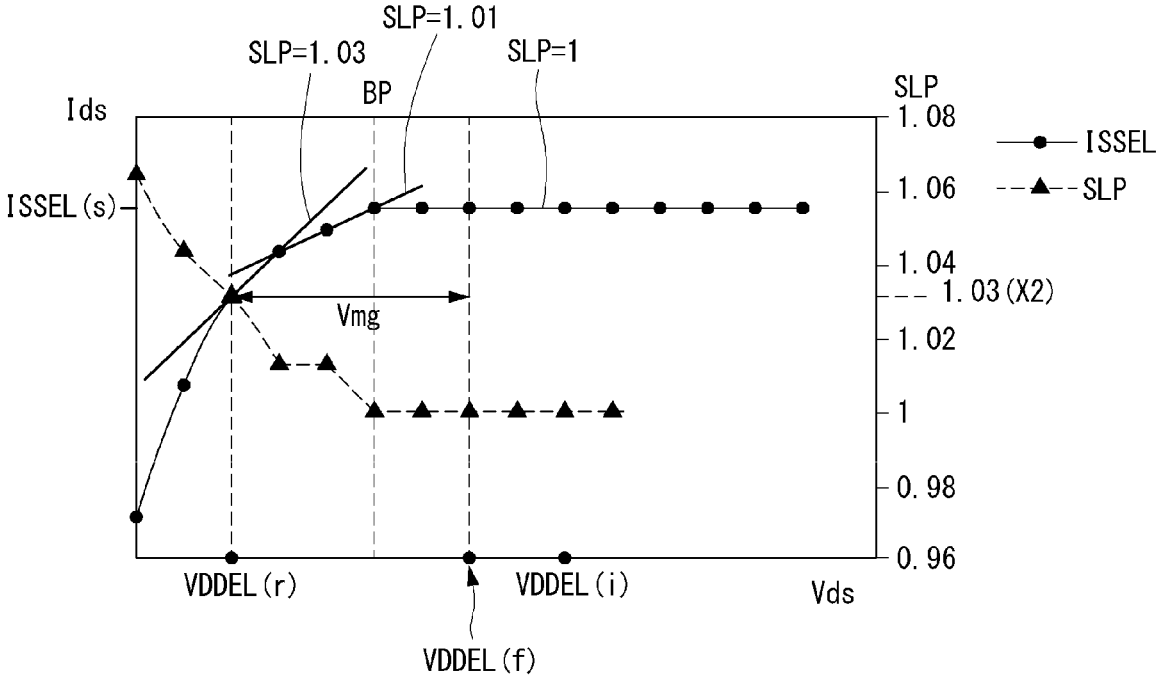
Figure 12:
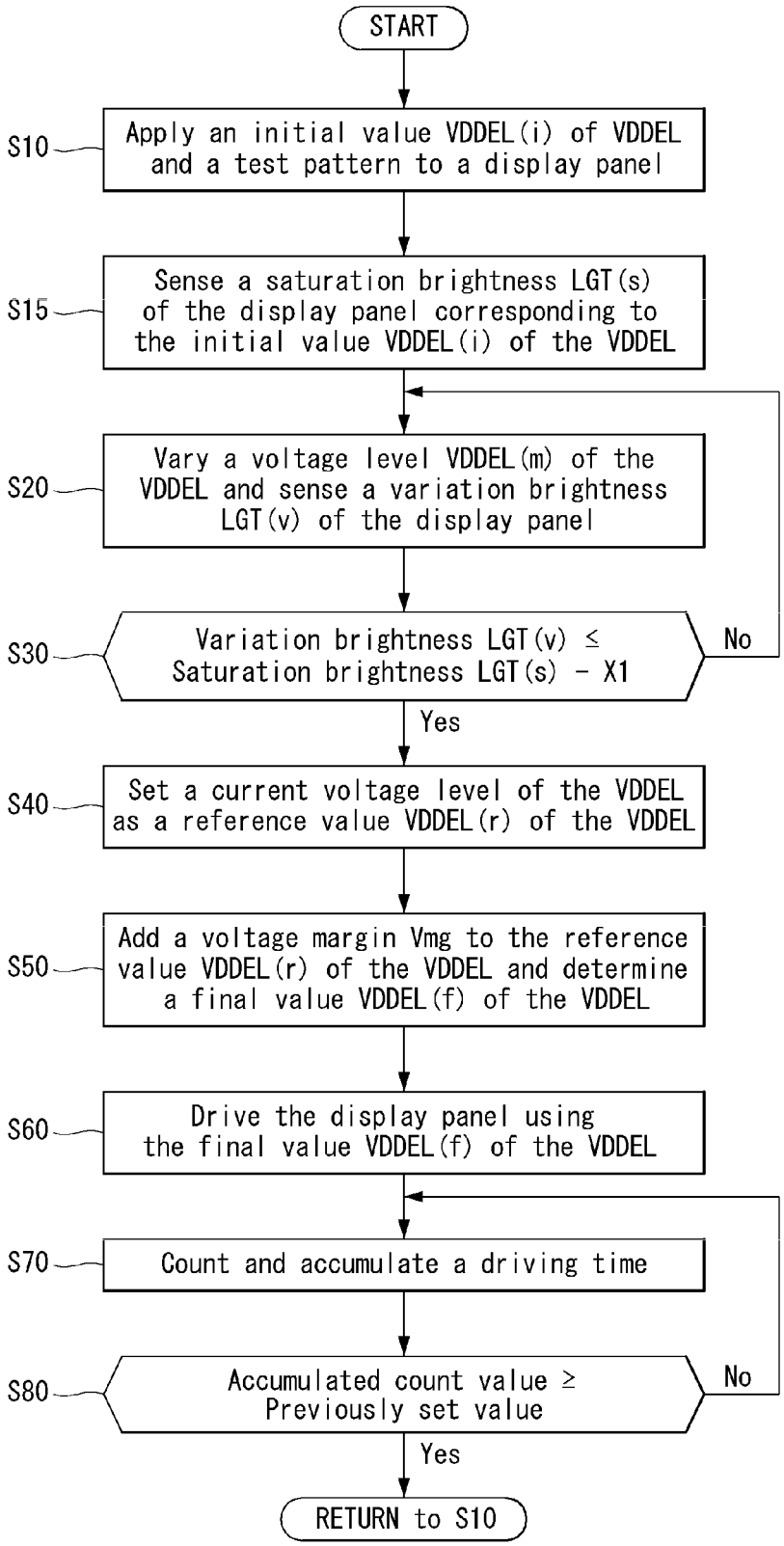
Figure 13:
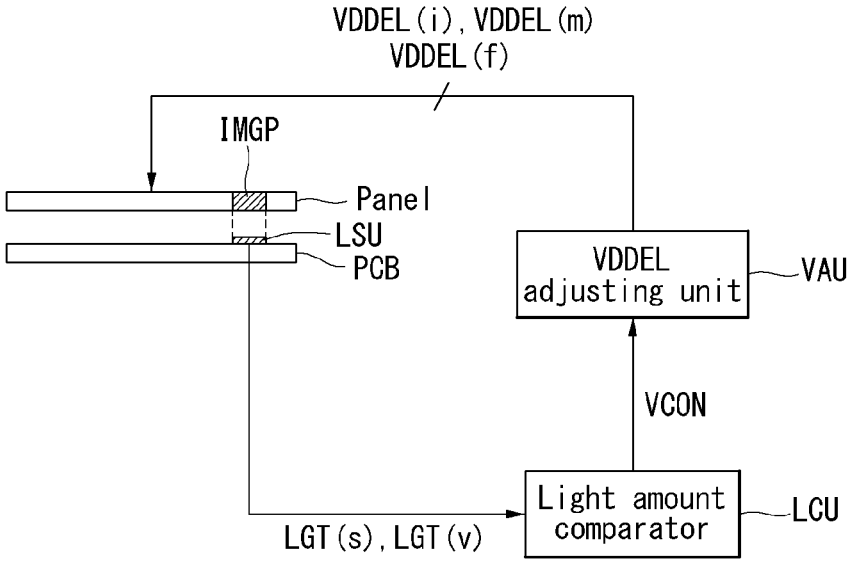
Figure 14:
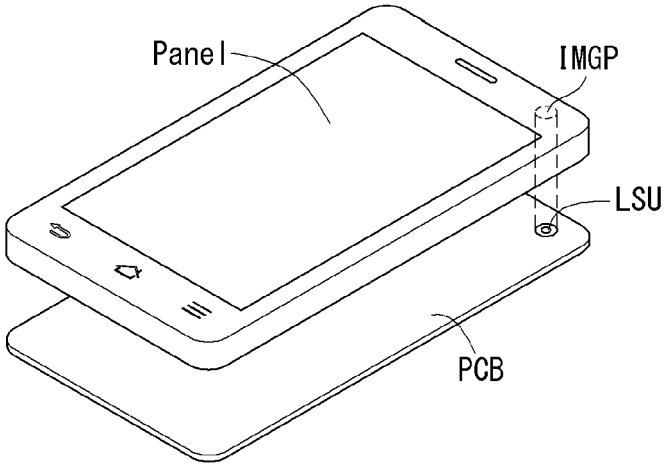
Figure 15:
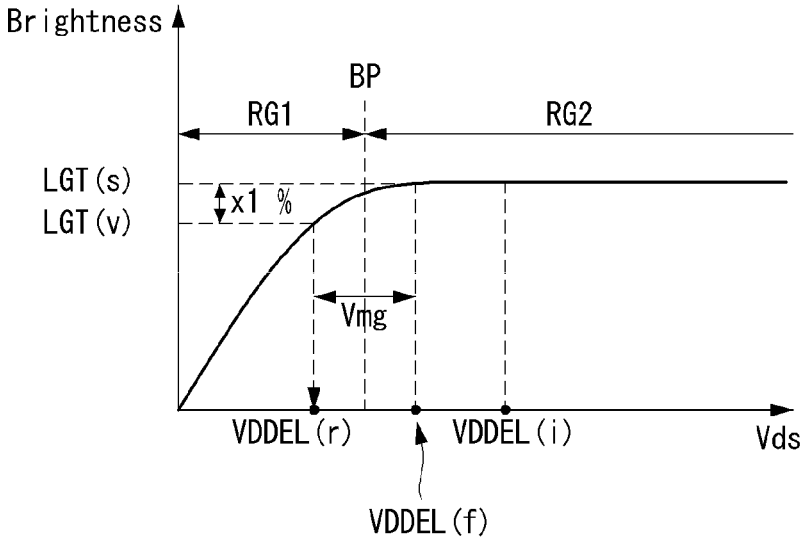
Figure 16:
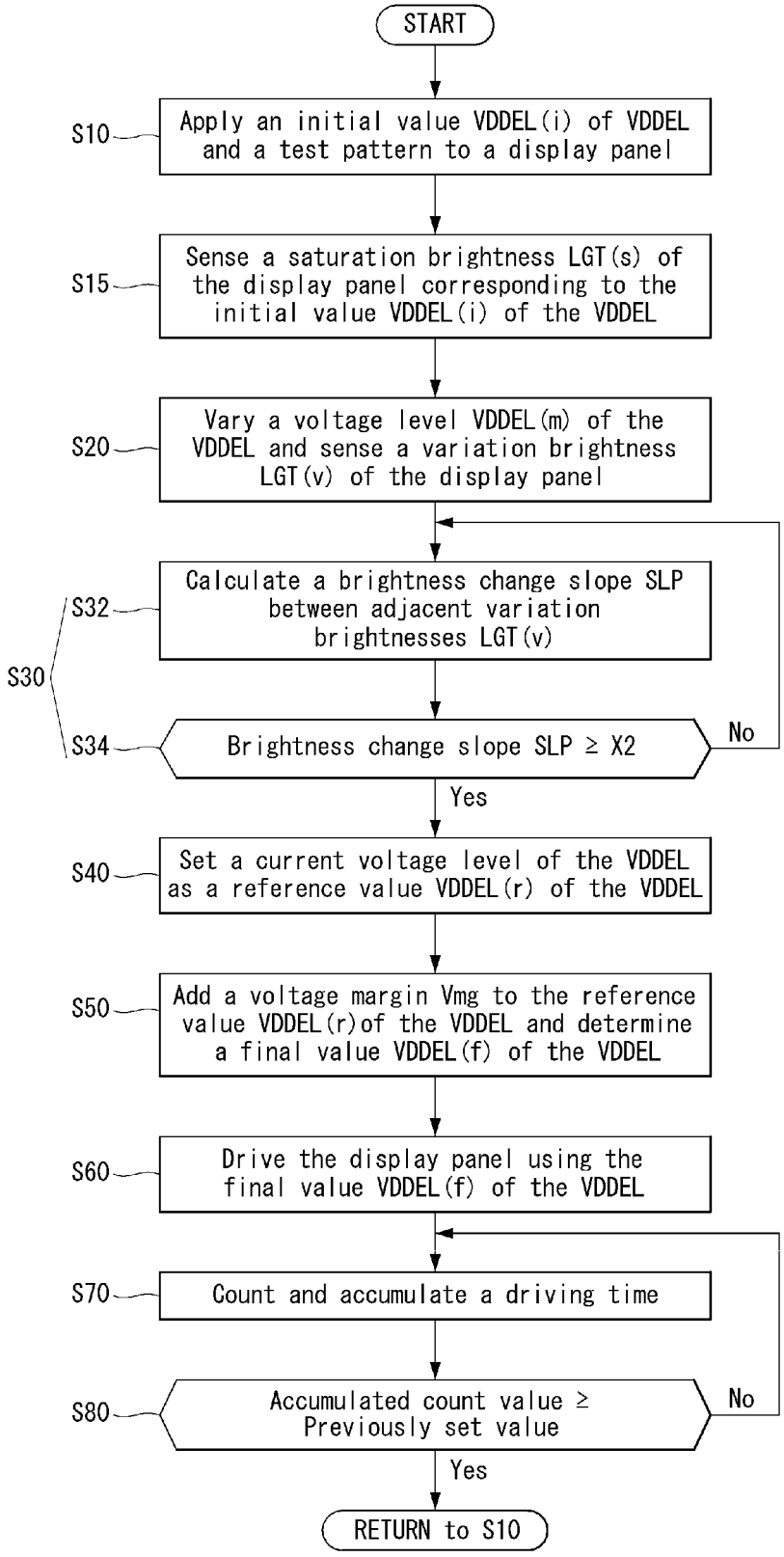
Figure 17:
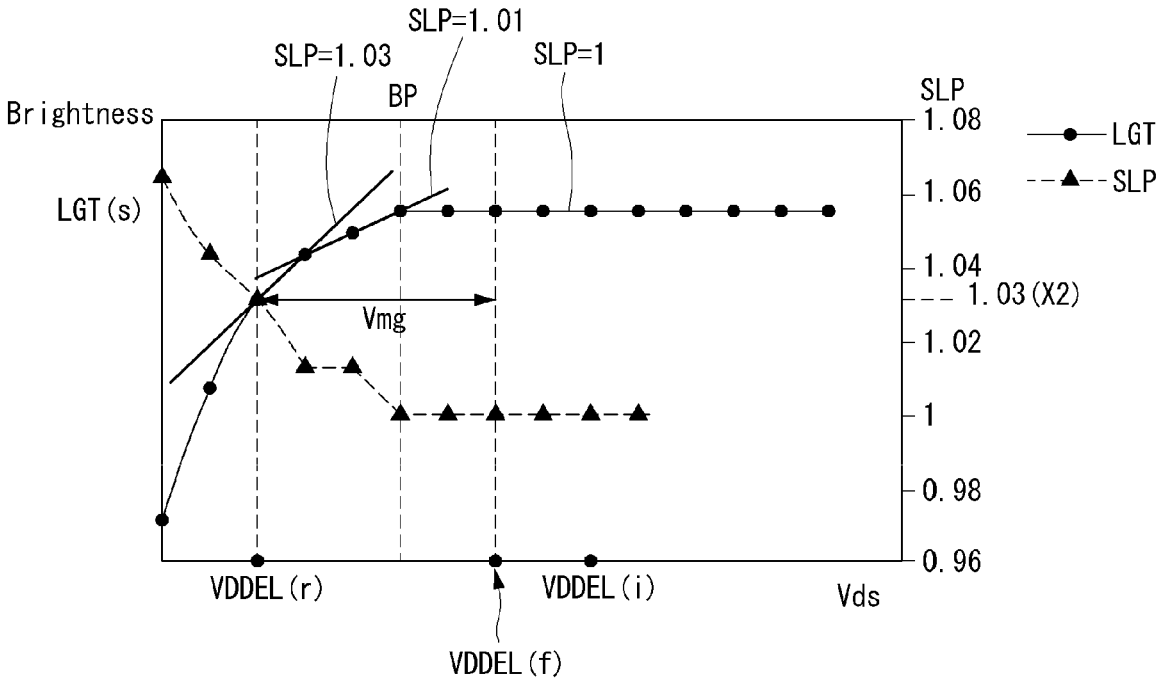
Figure 18:
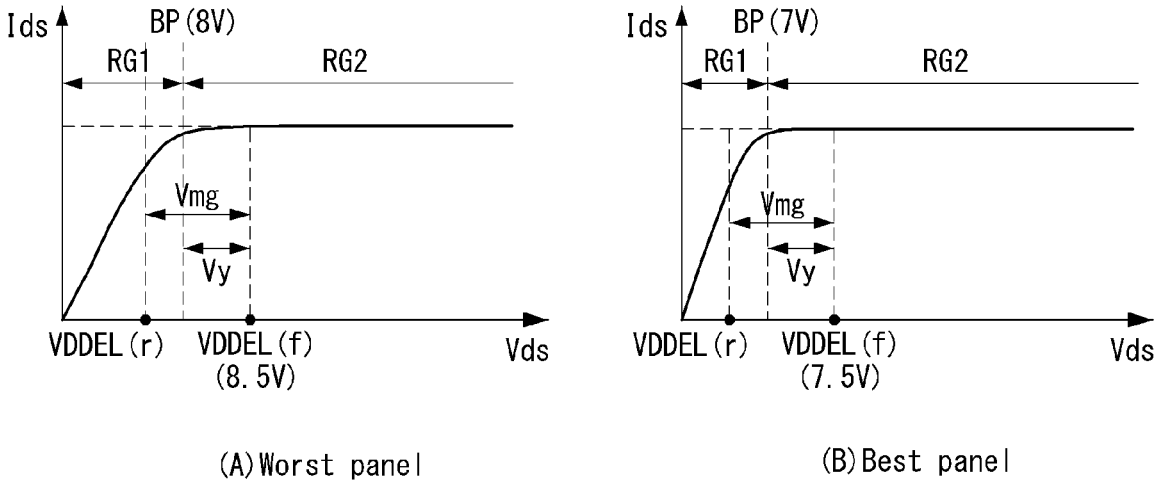
Figure 19:
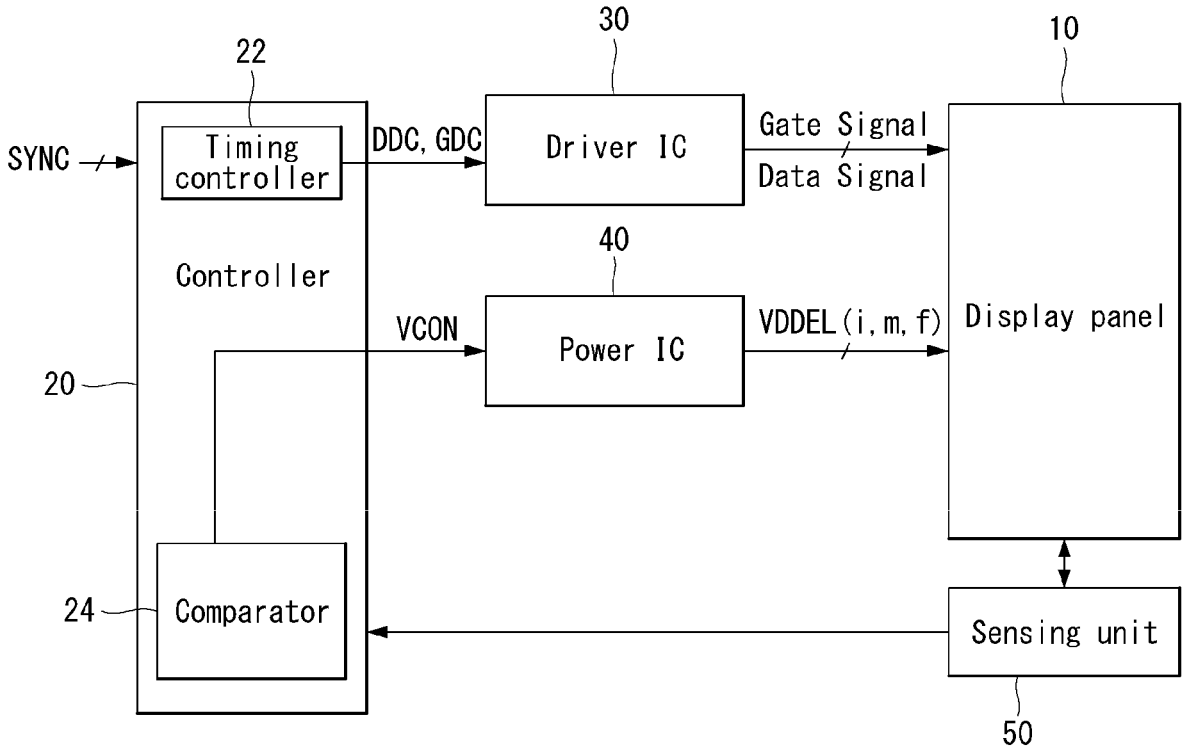

and a driving thin film transistor (TFT) connected between a high potential driving power (hereinafter, referred to as "VDDEL") and a low potential driving power (hereinafter, referred to as "VSSEL") according to the related art;

FIG. 2 shows an active region and a saturation region divided by a boundary point on an operating characteristic curve of the driving TFT according to the related art;

FIG. 3 shows an example where display panels of the same model have different voltage margins from a boundary point in the related art;

FIG. 4 illustrates a method for driving an organic light emitting display according to an exemplary embodiment of the invention;

FIG. 5 shows power lines connected to pixels of a display panel according to an example of the invention;

FIG. 6 schematically shows a connection configuration of a pixel shown in FIG. 5;

FIG. 7 illustrates in detail a driving method for optimizing the VDDEL based on a sensing result of an total current according to an exemplary embodiment of the invention;

FIG. 8 shows configuration of a device for optimizing the VDDEL based on a sensing result of an total current according to an exemplary embodiment of the invention;

FIG. 9 illustrates a process and a result for optimizing the VDDEL in accordance with the driving method of FIG. 7;

FIG. 10 illustrates in detail another driving method for optimizing the VDDEL based on a sensing result of an total current according to an exemplary embodiment of the invention;

FIG. 11 illustrates a process and a result for optimizing the VDDEL in accordance with the driving method of FIG. 10;

FIG. 12 illustrates in detail a driving method for optimizing the VDDEL based on a sensing result of brightness of transmitted light according to an exemplary embodiment of the invention;

FIG. 13 shows configuration of a device for optimizing the VDDEL based on a sensing result of brightness of transmitted light according to an exemplary embodiment of the invention;

FIG. 14 shows an example of a formation position of a monitoring unit and a light sensing unit of FIG. 13;

FIG. 15 illustrates a process and a result for optimizing the VDDEL in accordance with the driving method of FIG. 12;

FIG. 16 illustrates in detail another driving method for optimizing the VDDEL based on a sensing result of brightness of transmitted light according to an exemplary embodiment of the invention;

FIG. 17 illustrates a process and a result for optimizing the VDDEL in accordance with the driving method of FIG. 16;

FIG. 18 shows an example where display panels of the same model have the same voltage margin from a boundary point in an exemplary embodiment of the invention; and FIG. 19 shows an organic light emitting display according to an exemplary embodiment of the invention.

DETAILED DESCRIPTION OF THE ILLUSTRATED EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Exemplary embodiments of the invention will be described with reference to FIGS. 4 to 19.

FIG. 4 illustrates a method for driving an organic light emitting display according to an exemplary embodiment of the invention. FIG. 5 shows power lines connected to pixels of a display panel according to an example of the invention. FIG. 6 schematically shows a connection configuration of a pixel shown in FIG. 5.

As shown in FIG. 4, a method for driving an organic light emitting display according to the embodiment of the invention (hereinafter, referred to as "driving method according to the embodiment of the invention") is considered for optimizing a high potential driving power (hereinafter, referred to as "VDDEL") based on each display panel. The driving method according to the embodiment of the invention may include steps S10 to S60 and may further include steps S70 and S80 in consideration of changes over time. All the components of the organic light emitting display according to all embodiments of the present invention are operatively coupled and configured.

The driving method according to the embodiment of the invention applies a predetermined initial value of the VDDEL and a test pattern to a display panel when a system is powered on by a user, in step S10.

As shown in FIGS. 5 and 6, the display panel may include a plurality of pixels PIX arranged in a matrix form. The pixels PIX may be commonly connected to the VDDEL through high potential power lines PL1 and may be commonly connected to a low potential driving power (hereinafter, referred to as "VSSEL") through low potential power lines PL2. Each pixel PIX may include a driving thin film transistor (TFT) DT controlling a driving current applied to an organic light emitting diode (OLED) and a switching unit SC programming a gate-source voltage (hereinafter, referred to as "Vgs") of the driving TFT DT. The switching unit SC sets the Vgs of the driving TFT DT in response to a gate signal from a gate line GL and a data signal from a data line DL. The switching unit SC may include at least one switching TFT, that is turned on or off in response to the gate signal, and at least one capacitor. The driving TFT DT generates a drain-source current (hereinafter, referred to as "Ids") based on the set Vgs and supplies the Ids to the OLED as the driving current. An amount of light emitted by the OLED is determined depending on the driving current.

The initial value of the VDDEL may be selected as a sufficient high voltage, so that the driving TFT DT can operate in a saturation region RG2. The saturation region RG2 indicates a voltage region, in which the Ids does not substantially change depending on a drain-source voltage (hereinafter, referred to as "Vds") of the driving TFT DT. The saturation region RG2 may be located on the right side of a boundary point BP on the Vds-Ids plane (referring to FIGS. 9, 11, 15, and 17).

The test pattern is a data pattern applied to the pixels PIX of the display panel through the data lines and may be a full white pattern or a display pattern indicating a specific logo.

The driving method according to the embodiment of the invention senses changes in driving characteristics of the display panel while stepwise varying a voltage level of the VDDEL from its initial value in a state where a test image is displayed on the display panel by the initial value of the VDDEL and the test pattern, in step S20.

In the following description, the term of "stepwise varying" includes "consecutively varying" and "non-consecutively varying". The driving characteristics of the display panel include at least one among a total current (hereinafter, referred to as "ISSEL"), which is a sum of currents flowing in the low potential power lines PL2 of the display panel and a brightness of light incident from the display panel. The ISSEL indicates a sum of the drain-source currents Ids entering into the low potential power lines PL2 from the pixels PIX.

The driving method according to the embodiment of the invention decides whether or not a sensed driving characteristic value satisfies a critical condition, in step S30. In the embodiment disclosed herein, the critical condition indicates a condition for deciding whether or not the sensed driving characteristic value (for example, a value of the ISSEL and/or a value of the brightness of transmitted light) exists in an active region RG1. The detailed critical condition is described later with reference to FIGS. 7, 10, 12, and 16. Hereinafter, the embodiment of the invention separately describes a method for determining the optimum VDDEL using the ISSEL and a method for determining the optimum VDDEL using the brightness of transmitted light transmitted through the display panel. However, the embodiment of the invention may determine the optimum VDDEL using both the ISSEL and the brightness of transmitted light.

The active region RG1 indicates a voltage region in which the Ids changes depending on the Vds of the driving TFT DT, and may be located on the left side of the boundary point BP on the Vds-Ids plane (referring to FIGS. 9, 11, 15, and 17). The active region RG1 is differentiated from the saturation region RG2 by the boundary point BP. The active region RG1 may include a linear region, in which the Ids linearly varies depending on the Vds, and a nonlinear region, in which the Ids nonlinearly varies depending on the Vds.

The driving method according to the embodiment of the invention returns to step S20 when the sensed driving characteristic value does not satisfy the critical condition as a result of the decision of step S30. The driving method according to the embodiment of the invention repeatedly performs steps S20 and S30 until the sensed driving characteristic value satisfies the critical condition.

The driving method according to the embodiment of the invention sets a voltage level of the VDDEL obtained when the sensed driving characteristic value satisfies the critical condition as a result of the decision of step S30, as a reference value of the VDDEL, in step S40.

The driving method according to the embodiment of the invention adds a predetermined voltage margin to the reference value of the VDDEL and determines a final value of the VDDEL, in step S50. The initial value of the VDDEL and the reference value of the VDDEL are provisional values that are used to determine the final value of the VDDEL. The voltage margin may be a fixed value which is not variable during the operation of the display panel. Also, the voltage margin may have the same value for all display panels belonging to the same model.

The reference value of the VDDEL is determined as a voltage value of the active region RG1. The voltage margin is selected as a minimum value among voltage values that cause the final value of the VDDEL to be determined in the saturation region RG2.

The driving method according to the embodiment of the invention drives the display panel using the final value of the VDDEL in step S60. The final value of the VDDEL means a compensated value of the VDDEL for driving the display panel.

The boundary point BP is characterized in that it may be shifted to the right due to the degradation of the driving TFT DT and the OLED over time. When the boundary point BP is shifted to the right (namely, when a width of the active region RG1 increases in a characteristic curve of the driving TFT DT), the previously determined final value of the VDDEL does not exist in (i.e. no longer falls within) the saturation region RG2 and belongs to (i.e. shifts to) the active region RG1. Therefore, the stability of an operation of the driving TFT DT may be reduced.

Hence, the driving method according to the embodiment of the invention may further include steps S70 and S80 for renewing the final value of the VDDEL to an optimum value depending on the changes over time.

The driving method according to the embodiment of the invention may count and accumulate a driving time in step S70 and may decide whether or not an accumulated count value is equal to or greater than a previously set value in step S80. Each time the accumulated count value is equal to or greater than the previously set value, the driving method according to the embodiment of the invention may return to step S10 and perform steps S10 to S60.

FIG. 7 illustrates in detail a driving method for optimizing the VDDEL based on a sensing result of the ISSEL according to the embodiment of the invention. FIG. 8 shows configuration of a device for optimizing the VDDEL based on the sensing result of the ISSEL according to the embodiment of the invention. FIG. 9 illustrates a process and a result for optimizing the VDDEL in accordance with the driving method of FIG. 7.

Referring to FIGS. 7 to 9, the driving method according to the embodiment of the invention applies a previously set initial value VDDEL(i) of the VDDEL and a test pattern to the display panel when the system is powered on by the user, in step S10. The initial value VDDEL(i) of the VDDEL may be selected as a sufficient high voltage, so that the driving TFT DT can operate in the saturation region RG2.

The driving method according to the embodiment of the invention senses a saturation ISSEL ISSEL(s) flowing in the low potential power lines PL2 of the display panel corresponding to the initial value VDDEL(i) of the VDDEL using a current sensing unit ISU in a state where a test image is displayed on the display panel by the initial value VDDEL(i) of the VDDEL and the test pattern, in step S15. The current sensing unit ISU senses voltages V1 and V2 of both terminals of a resistance R existing in the low potential power line PL2 and divides a difference (V1−V2) between the voltages V1 and V2 by the resistance R, thereby sensing the desired ISSEL.

The driving method according to the embodiment of the invention stepwise reduces a voltage level VDDEL(m) of the VDDEL from the initial value VDDEL(i) of the VDDEL through a VDDEL adjusting unit VAU in a state where the test image is displayed on the display panel by the initial value VDDEL(i) of the VDDEL and the test pattern. Further, the driving method according to the embodiment of the invention senses changes (i.e., a variation ISSEL ISSEL(v)) in the ISSEL flowing in the low potential power lines PL2 of the display panel through the current sensing unit ISU each time the voltage level VDDEL(m) of the VDDEL is reduced, in step S20.

The driving method according to the embodiment of the invention decides whether or not the variation ISSEL ISSEL (v) satisfies a critical condition using a current comparator ICU. In other words, the driving method according to the embodiment of the invention compares a reduction current, that is reduced from the saturation ISSEL ISSEL(s) by a previously set first value X1, with the variation ISSEL ISSEL(v) using the current comparator ICU and decides whether or not the variation ISSEL ISSEL(v) is equal to or less than the reduction current, in step S30. In the embodiment disclosed herein, the first value X1 may be 1% to 50% or 5% to 15%.

The driving method according to the embodiment of the invention returns to step S20 when the variation ISSEL ISSEL(v) is greater than the reduction current as a result of the decision of step S30 through the current comparator ICU. The driving method according to the embodiment of the invention repeatedly performs steps S20 and S30 until the variation ISSEL ISSEL(v) is equal to or less than the reduction current.

The driving method according to the embodiment of the invention sets a voltage level of the VDDEL obtained when the variation ISSEL ISSEL(v) is equal to or less than the reduction current as a result of the decision of step S30 through the current comparator ICU, as a reference value VDDEL(r) of the VDDEL, in step S40. The driving method according to the embodiment of the invention adds a previously set voltage margin Vmg to the reference value VDDEL(r) of the VDDEL to determine a final value VDDEL(f) of the VDDEL and outputs a power control signal VCON, in step S50.

The driving method according to the embodiment of the invention produces the final value VDDEL(f) of the VDDEL through the VDDEL adjusting unit VAU in response to the power control signal VCON from the current comparator ICU, supplies the final value VDDEL(f) of the VDDEL to the high potential power lines PL1 of the display panel, and drives the display panel using the final value VDDEL(f) of the VDDEL, in step S60.

The driving method according to the embodiment of the invention may further include steps S70 and S80 for renewing the final value VDDEL(f) of the VDDEL to an optimum value depending on the changes over time.

FIG. 10 illustrates in detail another driving method for optimizing the VDDEL based on a sensing result of the ISSEL according to the embodiment of the invention. FIG. 11 illustrates a process and a result for optimizing the VDDEL in accordance with the driving method of FIG. 10.

Referring to FIGS. 10 and 11 along with FIG. 8, the driving method according to the embodiment of the invention applies a previously set initial value VDDEL(i) of the VDDEL and a test pattern to the display panel when the system is powered on by the user, in step S10. The initial value VDDEL(i) of the VDDEL may be selected as a sufficient high voltage, so that the driving TFT DT can operate in the saturation region RG2.

The driving method according to the embodiment of the invention senses a saturation ISSEL ISSEL(s) flowing in the low potential power lines PL2 of the display panel corresponding to the initial value VDDEL(i) of the VDDEL using the current sensing unit ISU in a state where a test image is displayed on the display panel by the initial value VDDEL(i) of the VDDEL and the test pattern, in step S15. The current sensing unit ISU senses voltages V1 and V2 of both terminals of a resistance R existing in the low potential power line PL2 and divides a difference (V1−V2) between the voltages V1 and V2 by the resistance R, thereby sensing the desired ISSEL.

The driving method according to the embodiment of the invention stepwise reduces a voltage level VDDEL(m) of the VDDEL from the initial value VDDEL(i) of the VDDEL through the VDDEL adjusting unit VAU in a state where the test image is displayed on the display panel by the initial value VDDEL(i) of the VDDEL and the test pattern. Further, the driving method according to the embodiment of the invention senses changes (i.e., a variation ISSEL ISSEL(v)) in the ISSEL flowing in the low potential power lines PL2 of the display panel through the current sensing unit ISU each time the voltage level VDDEL(m) of the VDDEL is reduced, in step S20.

The driving method according to the embodiment of the invention decides whether or not the variation ISSEL ISSEL (v) satisfies a critical condition using the current comparator ICU. In other words, the driving method according to the embodiment of the invention calculates a current change slope SLP between the adjacent variation total currents ISSEL(v), which are successively sensed, using the current comparator ICU, in step S32.

For example, the variation ISSEL ISSEL(v) is sensed as 80 mA when the voltage level VDDEL(m) of the VDDEL is 8V, and the variation ISSEL ISSEL(v) is sensed as 79 mA when the voltage level VDDEL(m) of the VDDEL is 7.9V. In this instance, when the VDDEL is 7.9V, the current change slope SLP is 1.01 (=80 mA/79 mA).

An example of the current change slope SLP obtained through such a calculation method is shown in FIG. 11.

The driving method according to the embodiment of the invention compares the current change slope SLP with a previously set second value X2 and decides whether or not the current change slope SLP is equal to or greater than the second value X2, in step S34. In the embodiment disclosed herein, the second value X2 may be 2% (i.e., 1.02) to 5% (i.e., 1.05). For example, FIG. 11 shows that the second value X2 is set to 3% (i.e., 1.03).

The driving method according to the embodiment of the invention returns to step S20 when the current change slope SLP is less than the second value X2 as a result of the decision of step S34 through the current comparator ICU. The driving method according to the embodiment of the invention repeatedly performs steps S20 and S30 until the current change slope SLP is equal to or greater than the second value X2.

The driving method according to the embodiment of the invention sets a voltage level of the VDDEL obtained when the current change slope SLP is equal to or greater than the second value X2 as a result of the decision of step S34 through the current comparator ICU, as a reference value VDDEL(r) of the VDDEL, in step S40. The driving method according to the embodiment of the invention adds a previously set voltage margin Vmg to the reference value VDDEL(r) of the VDDEL to determine a final value VDDEL(f) of the VDDEL and outputs a power control signal VCON, in step S50.

The driving method according to the embodiment of the invention produces the final value VDDEL(f) of the VDDEL through the VDDEL adjusting unit VAU in response to the power control signal VCON from the current comparator ICU, supplies the final value VDDEL(f) of the VDDEL to the high potential power lines PL1 of the display panel, and drives the display panel using the final value VDDEL(f) of the VDDEL, in step S60.

The driving method according to the embodiment of the invention may further include steps S70 and S80 for renewing the final value VDDEL(f) of the VDDEL to an optimum value depending on the changes over time.

FIG. 12 illustrates in detail a driving method for optimizing the VDDEL based on a sensing result of brightness of transmitted light according to the embodiment of the invention. FIG. 13 shows configuration of a device for optimizing the VDDEL based on a sensing result of brightness of transmitted light according to the embodiment of the invention. FIG. 14 shows an example of a formation position of a monitoring unit and a light sensing unit shown in FIG. 13. FIG. 15 illustrates a process and a result for optimizing the VDDEL in accordance with the driving method of FIG. 12.

Referring to FIGS. 12 to 15, the driving method according to the embodiment of the invention applies a previously set initial value VDDEL(i) of the VDDEL and a test pattern to a monitoring unit IMGP of the display panel when the system is powered on by the user, in step S10. The initial value VDDEL(i) of the VDDEL may be selected as a sufficient high voltage, so that the driving TFT DT can operate in the saturation region RG2. The monitoring unit IMGP may be located in a display area of the display panel, on which the image is displayed. Alternatively, as shown in FIG. 14, the monitoring unit IMGP may be located in a non-display area (i.e., a bezel area) outside the display area of the display panel. The monitoring unit IMGP is implemented by normal pixels configured so that the emission layer is included in the OLED. When the monitoring unit IMGP is located in the display area of the display panel, the test pattern (for example, a display light of manufacturer logo displayed when the system is powered on) applied to the monitoring unit IMGP may be seen by the user. On the other hand, when the monitoring unit IMGP is located in the non-display area of the display panel, the test pattern applied to the monitoring unit IMGP may not be seen by the user.

The driving method according to the embodiment of the invention senses a saturation brightness LGT(s) of light incident from the monitoring unit IMGP corresponding to the initial value VDDEL(i) of the VDDEL using a light sensing unit LSU in a state where a test image is displayed on the monitoring unit IMGP by the initial value VDDEL(i) of the VDDEL and the test pattern, in step S15. The light sensing unit LSU may be disposed on a system printed circuit board (PCB) disposed on a back surface of the display panel. The light sensing unit LSU is structurally characterized in that it is located opposite the monitoring unit IMGP so that the light sensing can be smoothly performed.

The driving method according to the embodiment of the invention stepwise reduces a voltage level VDDEL(m) of the VDDEL from the initial value VDDEL(i) of the VDDEL through the VDDEL adjusting unit VAU in a state where the test image is displayed on the monitoring unit IMGP of the display panel by the initial value VDDEL(i) of the VDDEL and the test pattern. Further, the driving method according to the embodiment of the invention senses changes (i.e., a variation brightness LGT(v)) in brightness of light incident from the monitoring unit IMGP using the light sensing unit LSU each time the voltage level VDDEL(m) of the VDDEL is reduced, in step S20.

The driving method according to the embodiment of the invention decides whether or not the variation brightness LGT(v) satisfies a critical condition using a light amount comparator LCU. In other words, the driving method according to the embodiment of the invention compares a reduction brightness, that is reduced from the saturation brightness LGT(s) by a previously set first value X1, with the variation brightness LGT(v) using the light amount comparator LCU and decides whether or not the variation brightness LGT(v) is equal to or less than the reduction brightness, in step S30. In the embodiment disclosed herein, the first value X1 may be 1% to 50% or 5% to 15%.

The driving method according to the embodiment of the invention returns to step S20 when the variation brightness LGT(v) is greater than the reduction brightness as a result of the decision of step S30 through the light amount comparator LCU. The driving method according to the embodiment of the invention repeatedly performs steps S20 and S30 until the variation brightness LGT(v) is equal to or less than the reduction brightness.

The driving method according to the embodiment of the invention sets a voltage level of the VDDEL obtained when the variation brightness LGT(v) is equal to or less than the reduction brightness as a result of the decision of step S30 through the light amount comparator LCU, as a reference value VDDEL(r) of the VDDEL, in step S40. The driving method according to the embodiment of the invention adds a previously set voltage margin Vmg to the reference value VDDEL(r) of the VDDEL to determine a final value VDDEL(f) of the VDDEL and outputs a power control signal VCON, in step S50.

The driving method according to the embodiment of the invention produces the final value VDDEL(f) of the VDDEL through the VDDEL adjusting unit VAU in response to the power control signal VCON from the light amount comparator LCU, supplies the final value VDDEL(f) of the VDDEL to the high potential power lines PL1 of the display panel, and drives the display panel using the final value VDDEL(f) of the VDDEL, in step S60.

The driving method according to the embodiment of the invention may further include steps S70 and S80 for renewing the final value VDDEL(f) of the VDDEL to an optimum value depending on the changes over time.

FIG. 16 illustrates in detail another driving method for optimizing the VDDEL based on a sensing result of brightness of transmitted light according to the embodiment of the invention. FIG. 17 illustrates a process and a result for optimizing the VDDEL in accordance with the driving method of FIG. 16.

Referring to FIGS. 16 and 17 along with FIG. 13, the driving method according to the embodiment of the invention applies a previously set initial value VDDEL(i) of the VDDEL and a test pattern to the monitoring unit IMGP of the display panel when the system is powered on by the user, in step S10. The initial value VDDEL(i) of the VDDEL may be selected as a sufficient high voltage, so that the driving TFT DT can operate in the saturation region RG2. A position of the monitoring unit IMGP was described above.

The driving method according to the embodiment of the invention senses a saturation brightness LGT(s) of light incident from the monitoring unit IMGP corresponding to the initial value VDDEL(i) of the VDDEL using the light sensing unit LSU in a state where a test image is displayed on the monitoring unit IMGP by the initial value VDDEL(i) of the VDDEL and the test pattern, in step S15. A position of the light sensing unit LSU was described above.

The driving method according to the embodiment of the invention stepwise reduces a voltage level VDDEL(m) of the VDDEL from the initial value VDDEL(i) of the VDDEL through the VDDEL adjusting unit VAU in a state where the test image is displayed on the monitoring unit IMGP of the display panel by the initial value VDDEL(i) of the VDDEL and the test pattern. Further, the driving method according to the embodiment of the invention senses changes (i.e., a variation brightness LGT(v)) in brightness of light incident from the monitoring unit IMGP using the light sensing unit LSU each time the voltage level VDDEL(m) of the VDDEL is reduced, in step S20.

The driving method according to the embodiment of the invention decides whether or not the variation brightness LGT(v) satisfies a critical condition using the light amount comparator LCU. In other words, the driving method according to the embodiment of the invention calculates a brightness change slope SLP between the adjacent variation brightnesses LGT(v), which are successively sensed, using the light amount comparator LCU, in step S32.

For example, the variation brightness LGT(v) is sensed as 80 nit when the voltage level VDDEL(m) of the VDDEL is 8V, and the variation brightness LGT(v) is sensed as 79 nit when the voltage level VDDEL(m) of the VDDEL is 7.9V. In this instance, when the VDDEL is 7.9V, the brightness change slope SLP is 1.01 (=80 nit/79 nit).

An example of the brightness change slope SLP obtained through such a calculation method is shown in FIG. 17.

The driving method according to the embodiment of the invention compares the brightness change slope SLP with a previously set second value X2 and decides whether or not the brightness change slope SLP is equal to or greater than the second value X2, in step S34. In the embodiment disclosed herein, the second value X2 may be 2% to 5%. For example, FIG. 17 shows that the second value X2 is set to 3% (i.e., 1.03).

The driving method according to the embodiment of the invention returns to step S20 when the brightness change slope SLP is less than the second value X2 as a result of the decision of step S34 through the light amount comparator LCU. The driving method according to the embodiment of the invention repeatedly performs steps S20 and S30 until the brightness change slope SLP is equal to or greater than the second value X2.

The driving method according to the embodiment of the invention sets a voltage level of the VDDEL obtained when the brightness change slope SLP is equal to or greater than the second value X2 as a result of the decision of step S34 through the light amount comparator LCU, as a reference value VDDEL(r) of the VDDEL, in step S40. The driving method according to the embodiment of the invention adds a previously set voltage margin Vmg to the reference value VDDEL(r) of the VDDEL to determine a final value VDDEL(f) of the VDDEL and outputs a power control signal VCON, in step S50.

The driving method according to the embodiment of the invention produces the final value VDDEL(f) of the VDDEL through the VDDEL adjusting unit VAU in response to the power control signal VCON from the light amount comparator LCU, supplies the final value VDDEL(f) of the VDDEL to the high potential power lines PL1 of the display panel, and drives the display panel using the final value VDDEL(f) of the VDDEL, in step S60.

The driving method according to the embodiment of the invention may further include steps S70 and S80 for renewing the final value VDDEL(f) of the VDDEL to an optimum value depending on the changes over time.

FIG. 18 shows an example where display panels of the same model have the same voltage margin from a boundary point BP when applying the embodiment of the invention.

Display panels of the same model have different boundary point voltages because of a process deviation therebetween. In the related art, a voltage value of the VDDEL in all the display panels of the same model was determined based on the worst-performing display panel having a maximum boundary point voltage, so that the voltage value of the VDDEL in all the display panels of the same model existed in the saturation region. The voltage value of the VDDEL determined based on the worst-performing display panel was equally applied to all the display panels of the same model. Therefore, the voltage margin of the best-performing display panel is different from that of the worst-performing display panel. More particularly, the voltage margin of the best-performing display panel is larger than that of the worst-performing display panel. Thus, in the related art, the display panel similar to the best-performing display panel had an unnecessarily large voltage margin from a boundary point, which led to unnecessary power consumption.

The embodiment of the invention individually optimizes the VDDEL suitably for the characteristics of each display panel of the same model through the above-described driving method, considering that the display panels of the same model have the different boundary point voltages (for example, in FIG. 18, the worst-performing display panel (A) has the boundary point voltage of 8V and the best-performing display panel (B) has the boundary point voltage of 7V). Namely, the embodiment of the invention senses changes in the driving characteristics of the display panel while changing the voltage level of the VDDEL and sets the reference value VDDEL(r) of the VDDEL in the active region near the boundary point based on the sensing result. Then, the embodiment of the invention adds the minimum voltage margin Vmg to the set reference value VDDEL(r) of the VDDEL and determines the final value VDDEL(f) of the VDDEL in the saturation region near the boundary point.

As described above, because the embodiment of the invention optimizes the VDDEL suitably for the characteristics of each display panel, the embodiment of the invention has the following advantages. Firstly, the VDDEL in the display panels of the same model can be differently determined. For example, as shown in FIG. 18, the worst-performing display panel (A) may have the VDDEL of 8.5V, and the best-performing display panel (B) may have the VDDEL of 7.5V. Secondly, all display panels of the same model can be set to have the same voltage margin Vmg (which is a value from the reference value VDDEL(r) to the final value VDDEL(f) of each display panel). So, a voltage value Vy, which is a difference value the boundary point BP and the final value VDDEL(f), is the same in each display panel. Thirdly, because the voltage margin Vmg can be minimized through the optimization process, unnecessary power consumption can be effectively prevented.

FIG. 19 shows the organic light emitting display according to the embodiment of the invention.

As shown in FIG. 19, the organic light emitting display according to the embodiment of the invention includes a display panel 10, a controller 20, a driver integrated circuit (IC) 30, a power IC 40, and a sensing unit 50. The controller 20 may include a timing controller 22 and a comparator 24.

On the display panel 10, a plurality of data lines and a plurality of gate lines cross each other, and pixels are respectively arranged at crossings of the data lines and the gate lines in a matrix form. The pixels were described above with reference to FIGS. 5 and 6. The display panel 10 includes power lines for sensing the current and a monitoring unit for sensing light. The monitoring unit may be located in a display area of the display panel 10 and may be located in a non-display area outside the display area.

The controller 20 may include a counter for counting a driving time, a register for storing an accumulated count value, and a comparator for comparing the accumulated count value with a setting value.

The timing controller 22 may generate a data control signal DDC and a gate control signal GDC for controlling operation timing of the driver IC 30 based on a timing sync signal SYNC input from the outside.

The comparator 24 includes the current comparator ICU and the light amount comparator LCU described above.

The driver IC 30 includes a source driver driving the data lines and a gate driver driving the gate lines. The source driver generates various values of a data voltage including a test pattern in response to the data control signal DDC and then supplies the data voltage to the data lines. The gate driver generates a gate signal for selecting horizontal display lines of the display panel 10, to which the data voltage will be applied, and supplies the gate signal to the gate lines in a sequential line manner.

The power IC 40 includes the above-described VDDEL adjusting unit VAU. The power IC 40 produces the initial value VDDEL(i) of the VDDEL and the final value VDDEL (f) of the VDDEL in response to the power control signal VCON from the comparator 24 and applies them to the display panel 10.

The sensing unit 50 includes the current sensing unit ISU and the light sensing unit LSU described above. The sensing unit 50 may be disposed on a system PCB disposed on a back surface of the display panel 10.

The light sensing unit LSU is structurally characterized in that it is located opposite the monitoring unit so that light incident from the monitoring unit of the display panel 10 can be smoothly sensed.

As described above, because the embodiment of the invention optimizes the VDDEL suitably for the characteristics of each display panel, the embodiment of the invention has the advantages in that the VDDEL in the display panels of the same model can be differently determined, the VDDEL in the display panels of the same model can have the same voltage margin from the boundary point, and the unnecessary power consumption can be prevented or minimized because the voltage margin can be minimized through the optimization process. The embodiment of the invention finds the reference value of the VDDEL for a short period of time using the fact that the driving characteristics of the display panel change depending on changes in the VDDEL, and adds the minimum voltage margin to the reference value of the VDDEL so that the driving TFT can operate in the saturation region. Therefore, the final value of the VDDEL can be reduced, and the unnecessary heat generation of the driving TFT can be greatly reduced.

When the embodiment of the invention is applied to mobile devices or wearable smart devices having small battery power, the embodiment of the invention can reduce the power consumption and the heat generation and can increase lifespan of the devices.

The embodiments of the invention may be described as follows.

A method for driving an organic light emitting display comprises applying an initial value of a high potential driving power and a test pattern to a display panel and sensing changes in driving characteristics of the display panel while varying a voltage level of the high potential driving power from the initial value; deciding whether or not a sensed driving characteristic value of the display panel satisfies a predetermined critical condition, setting a voltage level of the high potential driving power obtained when the sensed driving characteristic value satisfies the critical condition, as a reference value of the high potential driving power, and adding a voltage margin to the reference value of the high potential driving power to determine a final value of the high potential driving power; and driving the display panel using the final value of the high potential driving power, wherein the critical condition indicates a condition that causes the sensed driving characteristic value to exist in an active region in a driving thin film transistor (TFT) drain-source voltage (Vds)-drain-source current (Ids) plane of a display panel driving operation, and the final value of the high potential driving power is less than the initial value of the high potential driving power in a saturation region in the driving TFT Vds-Ids plane of the display panel driving operation following the active region.

The reference value of the high potential driving power is in the active region, and the voltage margin is selected as a minimum value among voltage values that cause the final value of the high potential driving power to fall within the saturation region.

The driving characteristic value of the display panel represents at least one among a total current flowing in low potential power lines of the display panel connected to a low potential driving power and a brightness of light generated from the display panel.

The method further comprises when the driving characteristic value of the display panel represents the total current, sensing a saturation total current corresponding to the initial value of the high potential driving power. The sensing changes in the driving characteristics of the display panel includes stepwise reducing the voltage level of the high potential driving power and sensing a variation total current each time the voltage level of the high potential driving power is reduced. The step of deciding whether or not the sensed driving characteristic value satisfies the critical condition includes comparing a reduction current, which is reduced from the saturation total current by a first value, with the variation total current and deciding whether or not the variation total current is equal to or less than the reduction current. The first value can be approximately 1% to 50% or approximately 5% to 15% of the saturation total current.

When the driving characteristic value of the display panel represents the total current, the sensing changes in the driving characteristics of the display panel includes stepwise reducing the voltage level of the high potential driving power and calculating a current change slope between adjacent variation total currents, which are successively sensed, while sensing the variation total current each time the voltage level of the high potential driving power is reduced. The step of deciding whether or not the sensed driving characteristic value satisfies the critical condition includes comparing the current change slope with a second value and deciding whether or not the current change slope is equal to or greater than the second value. The second value can be approximately 1.02 to 1.05.

The method further comprises when the driving characteristic value of the display panel represents the brightness of light, sensing a saturation brightness corresponding to the initial value of the high potential driving power. The sensing changes in the driving characteristics of the display panel includes stepwise reducing the voltage level of the high potential driving power and sensing a variation brightness each time the voltage level of the high potential driving power is reduced. The step of deciding whether or not the sensed driving characteristic value satisfies the critical condition includes comparing a reduction brightness, which is reduced from the saturation brightness by a first value, with the variation brightness and deciding whether or not the variation brightness is equal to or less than the reduction brightness. The first value can be approximately 1% to 50% or approximately 5% to 15% of the saturation brightness.

When the driving characteristic value of the display panel represents the brightness of light, the sensing changes in the driving characteristics of the display panel includes stepwise reducing the voltage level of the high potential driving power and calculating a brightness change slope between adjacent variation brightnesses, which are successively sensed, while sensing the variation brightness each time the voltage level of the high potential driving power is reduced.

The step of deciding whether or not the sensed driving characteristic value satisfies the critical condition includes comparing the brightness change slope with a second value and deciding whether or not the brightness change slope is equal to or greater than the second value. The second value can be approximately 1.02 to 1.05.

The method further comprises counting and accumulating a driving time, and deciding whether or not an accumulated count value is equal to or greater than a value. Each time the accumulated count value is equal to or greater than the value, sensing changes in the driving characteristics of the display panel and determining the final value of the high potential driving power are performed to renew the final value of the high potential driving power.

An organic light emitting display comprises a display panel including a plurality of pixels, each pixel including an organic light emitting diode (OLED) and a driving thin film transistor (TFT) connected between a high potential driving power and a low potential driving power; a driver integrated circuit (IC) configured to drive the display panel; a power IC configured to apply the high potential driving power to the display panel; a sensing unit configured to sense changes in driving characteristics of the display panel each time a voltage level of the high potential driving power varies from an initial value of the high potential driving power in a state where the initial value of the high potential driving power and a test pattern are applied to the display panel; and a comparator configured to decide whether or not a sensed driving characteristic value of the display panel satisfies a predetermined critical condition, to set a voltage level of the high potential driving power obtained when the sensed driving characteristic value satisfies the critical condition, as a reference value of the high potential driving power, and to add a voltage margin to the reference value of the high potential driving power to determine a final value of the high potential driving power. The critical condition indicates a condition that causes the sensed driving characteristic value to exist in an active region, which indicates a voltage region in which the drain-source current (Ids) changes depending on the drain-source voltage (Vds) of a driving TFT during a display panel driving operation, and the final value of the high potential driving power is less than the initial value of the high potential driving power in a saturation region following the active region.

The reference value of the high potential driving power is in the active region, and the voltage margin is selected as a minimum value among voltage values, that cause the final value of the high potential driving power to fall within the saturation region.

The driving characteristic value of the display panel represents at least one among a total current flowing in low potential power lines of the display panel connected to the low potential driving power and a brightness of light generated from the display panel.

The driving characteristic value of the display panel represents the total current. The sensing unit senses a saturation total current corresponding to the initial value of the high potential driving power and senses a variation total current each time the voltage level of the high potential driving power is stepwise reduced from the initial value. The comparator compares a reduction current, that is reduced from the saturation total current by a first value, with the variation total current and sets a voltage level of the high potential driving power obtained when the variation total current is equal to or less than the reduction current, as the reference value of the high potential driving power. The first value can be approximately 1% to 50% or approximately 5% to 15% of the saturation total current.

The driving characteristic value of the display panel represents the total current. The sensing unit senses a variation total current each time the voltage level of the high potential driving power is stepwise reduced from the initial value. The comparator calculates a current change slope between adjacent variation total currents which are successively sensed, compares the current change slope with a second value, and sets a voltage level of the high potential driving power obtained when the current change slope is equal to or greater than the second value, as the reference value of the high potential driving power. The second value can be approximately 1.02 to 1.05.

The driving characteristic value of the display panel represents the brightness of light. The sensing unit senses a saturation brightness corresponding to the initial value of the high potential driving power and senses a variation brightness each time the voltage level of the high potential driving power is stepwise reduced from the initial value. The comparator compares a reduction brightness, that is reduced from the saturation brightness by a first value, with the variation brightness and sets a voltage level of the high potential driving power obtained when the variation brightness is equal to or less than the reduction brightness, as the reference value of the high potential driving power. The first value can be approximately 1% to 50% or approximately 5% to 15% of the saturation brightness.

The driving characteristic value of the display panel represents the brightness of light. The sensing unit senses a variation brightness each time the voltage level of the high potential driving power is stepwise reduced from the initial value. The comparator calculates a brightness change slope between adjacent variation brightnesses which are successively sensed, compares the brightness change slope with a second value, and sets a voltage level of the high potential driving power obtained when the brightness change slope is equal to or greater than the second value, as the reference value of the high potential driving power. The second value can be approximately 1.02 to 1.05.

The organic light emitting display further comprises a controller configured to count and accumulate a driving time and decide whether or not an accumulated count value is equal to or greater than a value. Each time the accumulated count value is equal to or greater than the previously set value, the controller controls operations of the driver IC, the power IC, the sensing unit, and the comparator and renews the final value of the high potential driving power.

The driving characteristic value of the display panel represents the brightness of light. The display panel includes a monitoring unit on which the test pattern is displayed. The sensing unit is on a back surface of the display panel and is located opposite the monitoring unit.

The monitoring unit can be located in a display area of the display panel. In another example, the monitoring unit can be located in a non-display area of the display panel.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for driving an organic light emitting display, the method comprising:

applying, to a display panel, a first potential driving power having an initial value, a second potential driving power and a test pattern, wherein the first potential driving power is different than the second potential driving power;

displaying a test image by the display panel based on the test pattern and sensing a brightness of light generated from the test image by a light sensor within the organic light emitting display;

varying a voltage level of the first potential driving power and sensing a variation brightness of the display panel by the light sensor;

determining whether the variation brightness satisfies a condition that includes a change in the brightness of light being less than or equal to a reduction brightness value, setting a voltage level of the first potential driving power obtained in response to the variation brightness satisfying the condition, as a reference value of the first potential driving power, and adding a voltage margin to the reference value of the first potential driving power to determine a final value of the first potential driving power; and driving the display panel by applying the final value of the first potential driving power to the display panel, wherein the condition indicates that the variation brightness exists in an active region in a driving thin film transistor (TFT) drain-source voltage (Vds)-drain-source current (Ids) plane of a display panel driving operation, and the final value of the first potential driving power is less than the initial value of the first potential driving power in a saturation region in the driving TFT Vds-Ids plane of the display panel driving operation following the active region, wherein the varying the voltage level of the first potential driving power and the sensing variation brightness of the display panel include stepwise reducing the voltage level of the first potential driving power and calculating a brightness change slope between variation brightnesses, which are successively sensed, while sensing a variation brightness each time the voltage level of the first potential driving power is reduced, and wherein the determining whether the variation brightness satisfies the condition includes comparing the brightness change slope with a second value and determining the brightness change slope is equal to or greater than the second value.

2. The method of claim 1, wherein the reference value of the first potential driving power is in the active region, and wherein the voltage margin is selected as a minimum value among voltage values that cause the final value of the first potential driving power to fall within the saturation region.

3. The method of claim 1, further comprising:

sensing a saturation brightness corresponding to the initial value of the first potential driving power, wherein the determining whether the variation brightness satisfies the condition includes comparing a reduction brightness, which is reduced from the saturation brightness by a first value, with the variation brightness and deciding whether or not the variation brightness is equal to or less than the reduction brightness value.

4. The method of claim 3, wherein the first value is 1% to 50% of the saturation brightness or 5% to 15% of the saturation brightness.

5. The method of claim 1, wherein the second value is 1.02 to 1.05.

6. The method of claim 1, further comprising:

counting and accumulating a driving time; and deciding whether or not an accumulated count value is equal to or greater than a set value, wherein each time the accumulated count value is equal to or greater than the set value, sensing changes in driving characteristics of the display panel is performed and determining the final value of the first potential driving power is performed to renew the final value of the first potential driving power.

7. An organic light emitting display comprising:

a display panel including a plurality of pixels, each pixel among the plurality of pixels including an organic light emitting diode (OLED) connected between a first potential driving power having an initial value and a second potential driving power, and a driving thin film transistor (TFT) connected between the first potential driving power and the second potential driving power, wherein the first potential driving power is different than the second potential driving power;

a driver integrated circuit (IC) configured to drive the display panel;

a power IC configured to apply the first potential driving power to the display panel; and a controller to configured to:

display a test image by the display panel based on a test pattern and sense a brightness of light generated from the test image by a light sensor within the organic light emitting display, vary a voltage level of the first potential driving power and sense a variation brightness of the display panel by the light sensor, determine whether the variation brightness satisfies a condition that includes a change in the brightness of light being less than or equal to a reduction brightness value, set a voltage level of the first potential driving power obtained in response to the variation brightness satisfying the condition, as a reference value of the first potential driving power, and add a voltage margin to the reference value of the first potential driving power to determine a final value of the first potential driving power, and drive the display panel by applying the final value of the first potential driving power to the display panel, wherein the condition indicates that the variation brightness exists in an active region in a driving thin film transistor (TFT) drain-source voltage (Vds)-drain-source current (Ids) plane of a display panel driving operation, and the final value of the first potential driving power is less than the initial value of the first potential driving power in a saturation region in the driving TFT Vds-Ids plane of the display panel driving operation following the active region, wherein the controller is further configured to vary the voltage level of the first potential driving power and sense variation brightness of the display panel by stepwise reducing the voltage level of the first potential driving power and calculating a brightness change slope between variation brightnesses, which are successively sensed, while sensing a variation brightness each time the voltage level of the first potential driving power is reduced, and wherein the controller is further configured to determine whether the variation brightness satisfies the condition by comparing the brightness change slope with a second value and determining the brightness change slope is equal to or greater than the second value.

8. The organic light emitting display of claim 7, wherein the reference value of the first potential driving power is in the active region, and wherein the voltage margin is selected as a minimum value among voltage values, that cause the final value of the first potential driving power to fall within the saturation region.

9. The organic light emitting display of claim 7, wherein the controller is further configured to:

sense a saturation brightness corresponding to the initial value of the first potential driving power, and determine whether the variation brightness satisfies the condition by comparing a reduction brightness, which is reduced from the saturation brightness by a first value, with the variation brightness and decide whether or not the variation brightness is equal to or less than the reduction brightness value.

10. The organic light emitting display of claim 9, wherein the first value is 1% to 50% of the saturation brightness or 5% to 15% of the saturation brightness.

11. The organic light emitting display of claim 7, wherein the second value is 1.02 to 1.05.

12. The organic light emitting display of claim 7, wherein the controller is further configured to count and accumulate a driving time and decide whether or not an accumulated count value is equal to or greater than a set value, wherein each time the accumulated count value is equal to or greater than the set value, the controller senses changes in driving characteristics of the display panel and determines the final value of the first potential driving power to renew the final value of the first potential driving power.

13. The organic light emitting display of claim 7, wherein the display panel includes a monitoring unit on which the test pattern is displayed, and wherein the light sensor is disposed on a back surface of the display panel and is located opposite the monitoring unit.

14. The organic light emitting display of claim 13, wherein the monitoring unit is located in a display area of the display panel.

15. The organic light emitting display of claim 13, wherein the monitoring unit and the light sensor are disposed in a non-display area of the display panel that is not viewable by a user of the organic light emitting display.

* * * * *